42-33 SR
9/15/86 OR 4,612,220

United States Patent [19]
Baxter

[11] Patent Number: 4,612,220
[45] Date of Patent: Sep. 16, 1986

[54] JIGSAW MESSAGE PADS

[76] Inventor: Gordon H. Baxter, 1 Paddock Close, Belton, Gt. Yarmouth, Norfolk, England

[21] Appl. No.: 660,947

[22] Filed: Oct. 15, 1984

[51] Int. Cl.[4] ..... B42D 15/04; B65D 75/54
[52] U.S. Cl. ..... 428/33; 156/227; 273/157 R; 428/542.8
[58] Field of Search ..... 229/92.8; 273/156, 157 R; 428/33, 131, 542.8; 156/227

[56] References Cited

U.S. PATENT DOCUMENTS 3,512,780 5/1970 Allison ..... 273/157 X
3,606,338 9/1971 Cannata ..... 428/33 X
4,087,576 5/1978 Patterson ..... 428/3 X
4,140,317 2/1979 Ramney ..... 273/157 X
4,200,222 4/1980 Fever ..... 428/40 X
4,336,664 6/1982 Penick et al. ..... 273/157 R X

OTHER PUBLICATIONS

British Design Registration No. 1013420, Issued Mar. 16, 1984 to G. H. Baxter.

*Primary Examiner*—Henry F. Epstein
*Attorney, Agent, or Firm*—Alexis Barron; Martin F. Savitzky

[57] ABSTRACT

A jigsaw message pad comprising a removable sheet of interlocked jigsaw pieces which is within a sleeve characterized bu an open end through which said sheet may be removed and a window through which one surface of said sheet can be viewed.

9 Claims, 7 Drawing Figures

FIG. 4
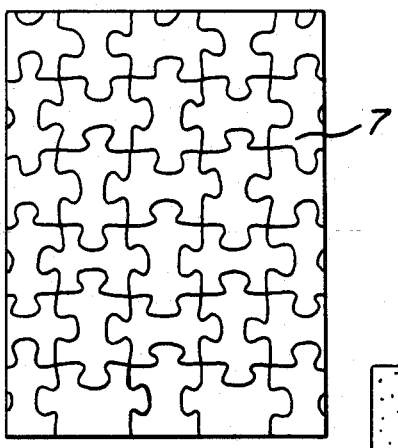
FIG. 5
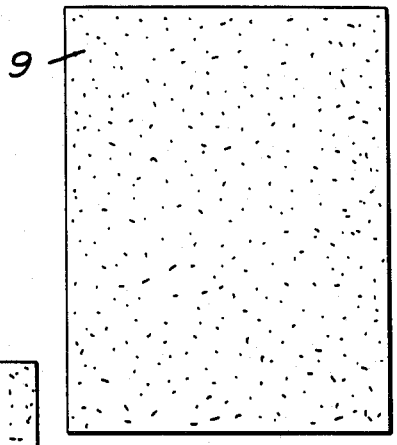
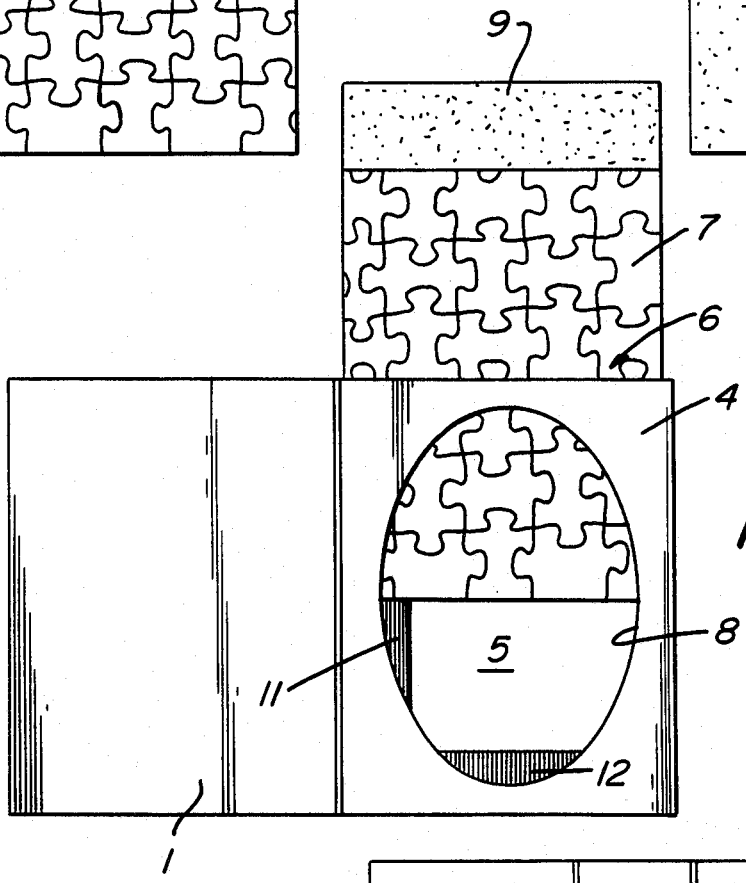
FIG. 6
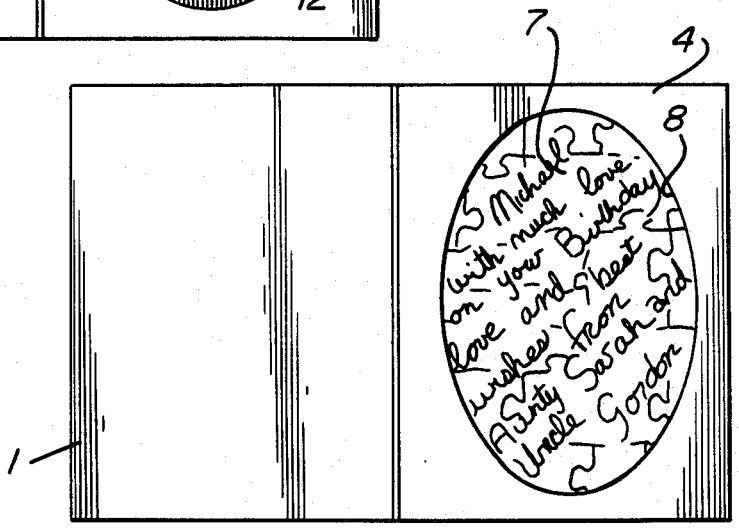
FIG. 7

JIGSAW MESSAGE PADS

FIELD OF THE INVENTION

This invention concerns jigsaw message pads, intended primarily but not exclusively for use as greeting cards.

Most people enjoy receiving a greeting card, upon the occasion of a birthday, anniversary or certain feast days such as Christmas, St. Valentine's Day or Mother's Day—but part of their pleasure lies in the sense of anticipation as one rips open its envelope and looks at the card within to discover who has sent the greeting and what it says. That pleasurable sense of anticipation would be prolonged if the message on the greeting card though decipherable were somehow encoded and thus able to be deciphered only after a kind of decoding operation. While most encoding/decoding operations are perphaps too sophisticated to appeal to the general public, nearly everyone must surely be well-accustomed to solving jigsaw puzzles—and this invention is therefore based upon the recognition that a message pad, especially when incorporated in a folder akin to a greetings card, will enable a message written upon the pad by the sender to be "encoded" by jumbling the pieces of the jigsaw puzzle, and on receipt by the addressee then "decoded" by solving the jigsaw puzzle, thus prolonging and increasing the recipient's pleasure.

SUMMARY OF THE INVENTION

According to one aspect of this invention there is therefore provided a jigsaw message pad, comprising a jigsaw puzzle in the form of a sheet of still-interlocked but separable jigsaw pieces, said sheet being removably inserted into a sleeve having an open end through which the jigsaw sheet can be inserted and withdrawn, said sleeve having at least one window extending partially or wholly across at least one face thereof, through which window the face of the jigsaw sheet can be seen and a message written thereupon can be read.

According to another aspect of the invention there is also provided a blank, from which a preferred form of the jigsaw messge pad herein disclosed may be constructed, said blank comprising a rectangular sleeve-back portion adapted to serve ultimately as the back of a sleeve, and hingedly-attached to one side of said sleeve-back portion via one or more folding lines a further peripherally-rectangular sleeve-front portion of essentially similar dimensions adapted to serve ultimately as the front of the sleeve, said sleeve-front portion having however an aperture therein adapted to serve ultimately as a window in said sleeve, and along two adjacent other sides of said sleeve-front portion of the blank and attached thereto via a folding line respective flap-portions, such that each said flap portion can be folded through 180° back onto one face of the apertured sleeve-front portion, coated with adhesive, and thereby adhered to the sleeve-back portion when it too is folded through 180° over and onto the adhesive-coated surfaces of the flap portions now overlying the apertured sleeve-front portion, forming when thus adhered thereto an open-ended sleeve.

The blank desirably will also include a further rectangular protective front-cover portion, of essentially identical dimensions to those of the sleeve-back portion and connected therewith, along the side opposite that upon which the apertured sleeve-front portion is connected thereto, via at least one folding line so that after the sleeve has been formed in the manner described herein the front-cover portion may be folded thereacross as a protective cover.

According to yet another aspect of this invention there is also provided a method of forming a jigsaw pad as herein disclosed, in which a blank as described above is folded and adhered together so as thus to construct a sleeve, and thereafter a jigsaw sheet and a backing sheet of substantially the same dimensions are both simultaneously or successively inserted into the sleeve so that the jigsaw sheet is visible through the aperture in the sleeve-front portion of the sleeve.

DETAILED DESCRIPTION

The message pad of this invention will normally incorporate a protective cover-sheet, hingedly attached to one side thereof and capable of being folded over the pad to obscure and protect the window, thus creating a folder more suitable for despatch via the post. The protective cover sheet can in suitable circumstances be decorated and/or bear a printed greeting.

The window may consist of or include a substantially transparent window-pane sheet, formed for instance of cellophane-type material, and indeed must do so if the window extends across the whole of one face of the sleeve, since then it is the window-pane sheet which serves as one face of the sleeve. When the window incorporates a window-pane sheet, it will be possible to write a message on the jigsaw sheet only when it has been withdrawn from the sleeve.

So that a message may be written upon the jigsaw sheet without the necessity first to withdraw the jigsaw sheet from the sleeve, it is preferred that the window shall not include a window-pane sheet, and thus the window will then consist of no more than an aperture in one face of the sleeve. In that event however the window may extend only partially across the face of the sleeve, since the remainder of that sleeve face must serve as peripheral lips to engage the edges of the jigsaw sheet and thus retain it within the sleeve.

So long as the aperture is such that the jigsaw sheet is engaged and retained in the sleeve, the shape and dimensions of the aperture are not important. For the sake of appearance it is however currently preferred that the aperture should be of round, oval or rectangular outline.

Desirably the pad will also incorporate a separate backing sheet, of essentially the same dimensions as the jigsaw sheet, which is to be inserted into the sleeve so that it lies behind the jigsaw sheet and thus is not visible through the window when these various components are correctly assembled, but upon which the jumbled pieces of the jigsaw can be re-assembled by the recipient; and, supported thereon, can then be re-inserted into the sleeve, so that the message written upon the jigsaw sheet and now deciphered by solving the jigsaw can be read through the window.

Both the jigsaw sheet and the backing sheet will conveniently be of rectangular outline, and of such dimensions slightly less than those of the sleeve that they can readily be inserted thereinto and withdrawn therefrom when desired.

The jigsaw sheet must of course have a surface of such a nature that a message can readily be written thereon, by means for instance of a felt tip pen or other writing instrument, and as currently envisaged will normally be of a plain white or other color—but it may bear decorative or like matter, provided that this is not so obtrusive as to interfere with the legibility of any message written upon the pad.

In order that the invention may be well understood a preferred embodiment thereof will now be described in more detail, though only by way of illustration, with reference to the accompanying drawings, in which:

FIG. 4 is a plan view of a jigsaw sheet, of rectangular outline, suitable for insertion into the folder shown in FIG. 1;

FIG. 5 is a plan view of a cardboard backing sheet, of similar rectangular outline, upon which the jigsaw sheet of FIG. 4 (and indeed the re-assembled jigsaw puzzle) may be mounted and supported as they are both inserted into the folder shown in FIG. 1;

Figure 3:
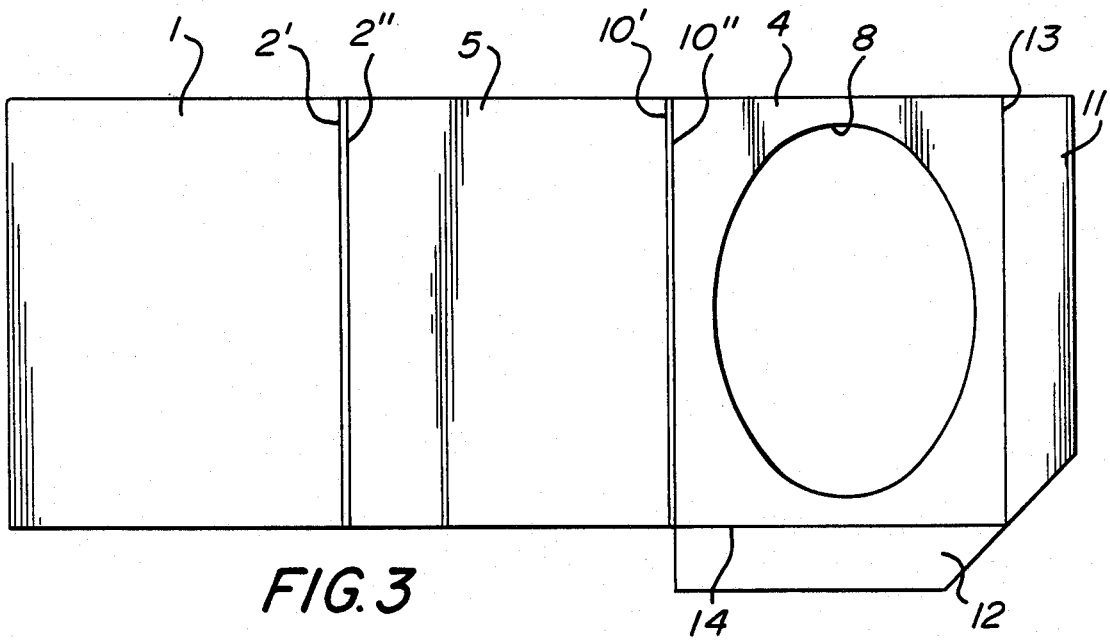
FIG. 3 is a plan view of a cardboard blank suitable for forming the folder shown in FIGS. 1 and 2.

FIG. 6 is a plan view of the inside of a folder constructed from the blank of FIG. 3, which moreover also shows the jigsaw sheet of FIG. 4, supported upon the backing sheet of FIG. 5, in their approximately half-inserted positions; and FIG. 7 is a plan view of the inside of the folder of FIG. 6, showing that part of the jigsaw sheet which is still visible through a window in the message pad when the former is fully inserted into the latter, and upon which a message has been written in manuscript.

Figure 1:
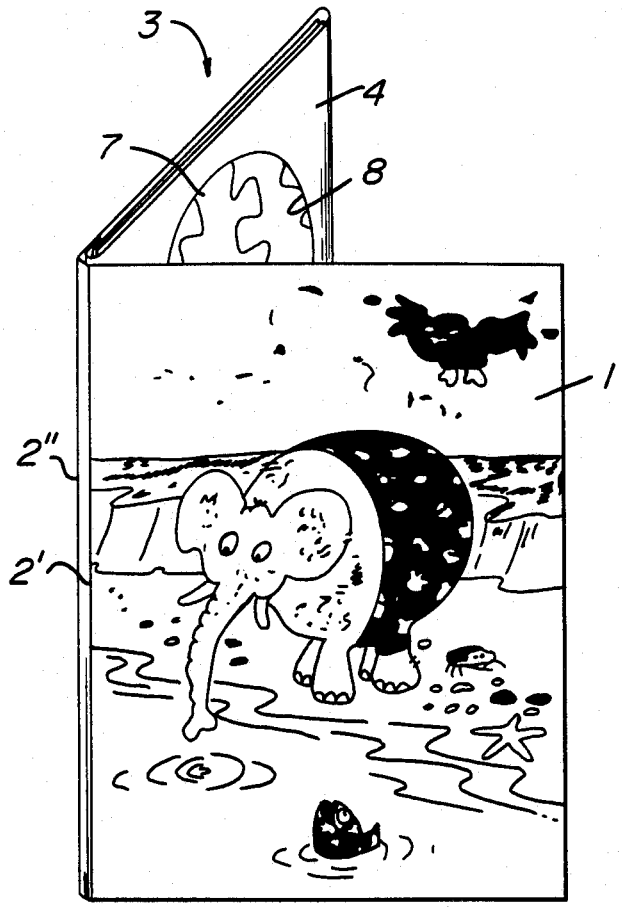
FIG. 1 is a perspective view of a folder incorporating a jigsaw message pad in accordance with this invention, in half-open position, as seen from the front and slightly above.
Figure 2:
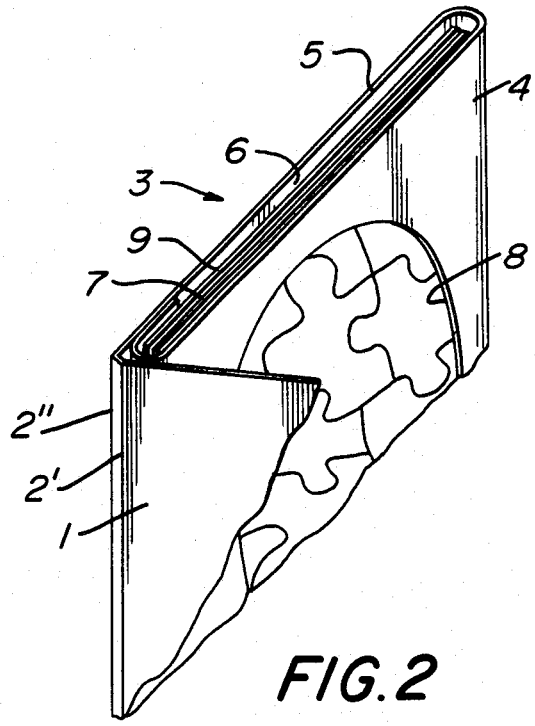
FIG. 2 is a fragmentary view, partly cut away and upon an enlarged and somewhat exaggerated scale, of the open top end of the sleeve, jigsaw sheet and backing sheet assembly of the folder shown in FIG. 1.

Referring first to FIG. 1, it will be seen that the jigsaw message pad takes the form of a folder made up as a greetings card, and which therefore has a front cover, which may (as shown) bear some kind of decorative or other suitable picture and/or wording, but which may also be blank. The front cover is hingedly attached via two closely-spaced, parallel folding lines 2' and 2'' (which in effect define the spine of the folder) onto a message pad, generally indicated 3 in FIG. 1. As will more clearly be seen from FIG. 2, the message pad 3 comprises a flat sleeve having a sleeve-front face 4 and a sleeve-back face 5, with a slit-like opening 6 therebetween at the top end thereof, through which there has been inserted a jigsaw puzzle sheet 7, part of which is visible through an aperture 8 which provides a window in the front face of the sleeve. As appears best in FIG. 2, the jigsaw puzzle sheet 7 lies within the sleeve upon a cardboard backing sheet 9.

FIG. 3 shows a cardboard blank from which the folder component of the jigsaw message pad of this invention may be constructed by folding and gumming it together in the following fashion. This blank comprises the already-mentioned front cover 1, the edge of which is attached hingedly via closely-spaced, parallel folding lines 2' and 2'' along one edge of the similarly-dimensioned sleeve-back 5, the opposite edge of which is attached hingedly, in a similar manner via further closely-spaced, parallel folding lines 10' and 10'', to one edge of the previously-mentioned sleeve-front 4, which has the window aperture 8 therein. The apertured sleeve-front 4 also has two flaps, respectively indicated 11 and 12, each attached hingedly via respective folding lines 13 and 14 to different edges of the apertured sleeve-front 4. As shown in FIG. 4, the flap 11 is attached along the edge of the apertured sleeve-front opposite the edge thereof along which the latter is hingedly attached to the sleeve-back 5; and the other flap 12 is hingedly attached along the edge of the apertured sleeve-front 4 which, in the finished sleeve, will form the closed bottom end of the sleeve.

The manner in which the complete jigsaw message pad folder is assembled can be seen from FIGS. 4, 5 and 6. FIG. 4 shows one of the components of the assembly, namely a rectangular jigsaw sheet 7; FIG. 5 shows another component, namely a similarly-dimensioned rectangular cardboard backing sheet 9; and FIG. 6 shows the jigsaw sheet 7, mounted upon the backing sheet 9, as both of them are in the course of insertion through slit 6 into the sleeve. It should however be noted that while in FIG. 6, so as to facilitate understanding of the procedure, the jigsaw sheet 7 is depicted as being inserted further into the sleeve than the backing sheet 9, in reality the jigsaw sheet 7 would normally be superimposed upon and thus fully supported by the backing sheet 9 at the time of insertion.

FIG. 7 shows the jigsaw message pad folder after it has been fully assembled, with part of the jigsaw sheet 7 visible through the window aperture 8 in the sleeve—and, in order to demonstrate the intended utimate use of the folder, it will be seen that in FIG. 7 the folder is shown with a greetings message written upon the part of the jigsaw sheet 7 which is visible through the window aperture.

I claim:

1. A jigsaw message pad, comprising:

a sheet having a writing surface and formed of interlocked but separable jigsaw puzzle pieces;

a sleeve having an open top end through which said sheet can be inserted and withdrawn and a closed bottom end adapted to retain said sheet when inserted into said sleeve, and having at least one window extending partially or wholly across at least one face thereof; and wherein through said window said writing surface can be seen and any message written thereupon can be read.

2. A message pad according to claim 1, which also incorporates a protective cover-sheet, hingedly attached to one side thereof and capable of being folded over the pad to obscure and protect the window, thus creating a folder.

3. A jigsaw message pad according to claim 2, in which the window consists of an aperture which extends only partially across the face of the sleeve, the remainder of said sleeve serving as peripheral lips to engage the edges of the jigsaw sheet and thus retain it within the sleeve.

4. A jigsaw message pad according to claim 3, in which the aperture is of round, oval or rectangular outline.

5. A jigsaw message pad according to claim 3 which incorporates a separate backing sheet, of essentially the same dimensions as the jigsaw sheet, inserted into the sleeve so that it lies behind the jigsaw sheet and thus is not visible through the window but upon which the jumbled pieces of the jigsaw can be reassembled by the recipient.

6. A blank, comprising a rectangular sleeve-back portion adapted to serve ultimately as the back of a sleeve, and hingedly-attached to one side of said sleeve-back portion via one or more folding lines a further peripherally-rectangular sleeve-front portion of essentially similar dimensions adapted to serve ultimately as the front of the sleeve, said sleeve-front portion having however an aperture therein adapted to serve ultimately as a window in said sleeve, and along two adjacent other sides of said sleeve-front portion of the blank and attached thereto via a folding line respective flap-portions, such that each said flap portion can be folded through 180° back onto one face of the apertured sleeve-front portion, coated with adhesive, and thereby adhered to the sleeve-back portion when it too is folded through 180° over and onto the adhesive-coated surfaces of the flap portions now overlying the apertured sleeve-front portion, forming when thus adhered thereto an open-ended sleeve.

7. A blank according to claim 6, which also includes a further rectangular protective front-cover portion, of essentially identical dimensions to those of the sleeve-back portion and connected therewith, along the side opposite that upon which the apertured sleeve-front portion is connected thereto, via at least one folding line.

8. A method of forming a jigsaw pad using a blank comprising a rectangular sleeve-back portion adapted to serve ultimately as the back of a sleeve; a peripherally-rectangular sleeve-front portion of dimensions essentially similar to said sleeve-back portion and having an aperture therein adapted to serve ultimately as a window in said sleeve, said sleeve-front portion adapted to serve ultimately as the front of said sleeve and hingedly-attached to one side of said sleeve-back portion via one or more folding lines; and, flap-portions attached to two adjacent other sides of said sleeve-front portion, wherein:

said flap-portions are folded back onto one face of said sleeve-front portion;

said sleeve-back portion is folded back onto said folded flap-portions;

said sleeve-back portion is adhered to said folded flap-portions so as thus to construct a sleeve; and a jigsaw sheet and a backing sheet of substantially the same dimensions are inserted into said sleeve so that said jigsaw sheet is visible through said aperture.

9. A method of forming a jigsaw pad according to claim 8 in which said blank also comprises a rectangular protective front-cover portion, of dimensions essentially identical to those of said sleeve-back portion, to which said front-cover portion is attached along the side of said sleeve-back portion opposite that to which said sleeve-front portion is attached, such that after said blank is folded and adhered together so as thus to construct said sleeve, and thereafter said jigsaw sheet and said backing sheet of substantially the same dimensions are inserted into said sleeve so that said jigsaw sheet is not visible through said aperture when said protective front-cover portion is folded onto said front-sleeve portion.

* * * * *